US010629418B2

(12) United States Patent
Hattori et al.

(10) Patent No.: US 10,629,418 B2
(45) Date of Patent: Apr. 21, 2020

(54) ELECTRON MULTIPLIER AND PHOTOMULTIPLIER TUBE

(71) Applicant: HAMAMATSU PHOTONICS K.K., Hamamatsu-shi, Shizuoka (JP)

(72) Inventors: Shinya Hattori, Hamamatsu (JP); Hiroshi Kobayashi, Hamamatsu (JP); Ginji Sugiura, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/317,947

(22) PCT Filed: Aug. 3, 2017

(86) PCT No.: PCT/JP2017/028240
§ 371 (c)(1),
(2) Date: Jan. 15, 2019

(87) PCT Pub. No.: WO2018/043024
PCT Pub. Date: Mar. 8, 2018

(65) Prior Publication Data

US 2019/0295829 A1 Sep. 26, 2019

(30) Foreign Application Priority Data

Aug. 31, 2016 (JP) ..... 2016-169806

(51) Int. Cl.
*H01J 43/20* (2006.01)
*H01J 43/24* (2006.01)

(52) U.S. Cl.
CPC ..... *H01J 43/243* (2013.01); *H01J 43/24* (2013.01)

(58) Field of Classification Search
None
See application file for complete search history.

(56) References Cited

U.S. PATENT DOCUMENTS

| | | | |
|---|---|---|---|
| 3,244,922 | A | 4/1966 | Wolfgang |
| 3,665,497 | A | 5/1972 | Deradorian et al. |
| 3,673,449 | A | 6/1972 | Eschard |

(Continued)

FOREIGN PATENT DOCUMENTS

| | | | |
|---|---|---|---|
| GB | 1064243 | A | 4/1967 |
| JP | S48-18030 | B1 | 6/1973 |
| JP | H01-501823 | A | 6/1989 |

(Continued)

OTHER PUBLICATIONS

International Preliminary Report on Patentability (IPRP) dated Mar. 14, 2019 that issued in WO Patent Appplicant No. PCT/JP2017/028240.

*Primary Examiner* — Vip Patel
(74) *Attorney, Agent, or Firm* — Faegre Drinker Biddle & Reath LLP

(57) ABSTRACT

A main body portion includes a first plate-shaped member and a second plate-shaped member that are stacked on each other in a second direction to form a first channel and a second channel, the first plate-shaped member includes a first front surface, a first back surface, a first hole portion area, and a first solid area, the second plate-shaped member includes a second front surface, a second back surface, a second hole portion area, and a second solid area, the first hole portion area faces the second solid area, the second hole portion area faces the first solid area.

10 Claims, 11 Drawing Sheets

(56) References Cited

U.S. PATENT DOCUMENTS 4,305,744 A 12/1981 Carette et al.

FOREIGN PATENT DOCUMENTS

| | | | |
|---|---|---|---|
| JP | H03-116626 | A | 5/1991 |
| JP | H05-144410 | A | 6/1993 |
| JP | 2004-200174 | A | 7/2004 |
| JP | 5215569 | B2 | 6/2013 |
| WO | WO-88/04105 | A1 | 6/1988 |

ELECTRON MULTIPLIER AND PHOTOMULTIPLIER TUBE

TECHNICAL FIELD

An aspect of the present invention relates to an electron multiplier and a photomultiplier tube.

BACKGROUND ART

Patent Literature 1 describes an electron multiplier including a rectangular parallelepiped dynode element in which a wave-shaped passage is provided. In this electron multiplier, the passage and the dynode element are formed by combining two blocks in which wave-shaped groove portions are formed.

CITATION LIST

Patent Literature

[Patent Literature 1] U.S. Pat. No. 3,244,922

SUMMARY OF INVENTION

Technical Problem

Incidentally, improving a gain or an output wave height distribution by providing a plurality of channels for an electron multiplier (multi-channelization) is being studied currently. As described above, in the electron multiplier described in Patent Literature 1, the wave-shaped groove portion is formed in each of the two blocks, and these blocks are combined to form one passage (channel).

Therefore, in order to perform multi-channelization, it is conceivable to arrange electron multipliers corresponding to the number of necessary channels and to integrate the electron multipliers. However, in this case, at least a portion between an outer front surface of each block and an inner surface of the groove portion is interposed between adjacent channels. Therefore, there is more dead space between the channels.

An object of an aspect of the present invention is to provide an electron multiplier and a photomultiplier tube capable of performing multi-channelization while curbing an increase in dead space.

Solution to Problem

An electron multiplier according to an aspect of the present invention includes: a main body portion extending in a first direction; a first channel that is provided in the main body portion to open at one end surface and the other end surface of the main body portion in the first direction and emits secondary electrons according to incident electrons; and a second channel that is provided in the main body portion to open at the one end surface and the other end surface in the first direction and emits secondary electrons according to the incident electrons, wherein the main body portion includes a first plate-shaped member and a second plate-shaped member that are stacked on each other in a second direction intersecting the first direction to faun the first channel and the second channel, the first plate-shaped member includes a first front surface and a first back surface intersecting the second direction, a first hole portion area in which a first hole portion reaching the first back surface from the first front surface and extending along the first front surface and the first back surface is formed, and a first solid area adjacent to the first hole portion area, the second plate-shaped member includes a second front surface and a second back surface intersecting the second direction, a second hole portion area in which a second hole portion reaching the second back surface from the second front surface and extending along the second front surface and the second back surface is formed, and a second solid area adjacent to the second hole portion area, the first hole portion area faces the second solid area in the second direction, the second hole portion area faces the first solid area in the second direction, the first channel is formed to include an inner surface of the first hole portion and a surface facing the inside of the first hole portion in the second solid area, and the second channel is formed to include an inner surface of the second hole portion and a surface facing the inside of the second hole portion in the first solid area.

In this electron multiplier, a plurality of channels including the first channels and the second channels are provided in the main body portion. The main body portion includes the first plate-shaped members and the second plate-shaped members stacked on each other. The first plate-shaped member includes the first hole portion areas in which the first hole portions are formed, and the first solid areas adjacent to the first hole portion areas. The second plate-shaped member includes the second hole portion areas in which the second hole portions are formed, and the second solid areas adjacent to the second hole portion areas. The first hole portion areas of the first plate-shaped member face the second solid areas of the second plate-shaped member in the second direction (a stacking direction of the plate-shaped members). The second hole portion areas of the second plate-shaped member face the first solid areas of the first plate-shaped member in the second direction.

That is, at least one opening of the first hole portion in the second direction is closed by the second solid area of the second plate-shaped member, and at least one opening of the second hole portion in the second direction is closed by the first solid area of the first plate-shaped member. Accordingly, the first channel is formed to include the inner surface of the hole portion and the surface facing the inside of the first hole portion in the second solid area, and the second channel is formed to include the inner surface of the second hole portion and the surface facing the inside of the second hole portion in the first solid area.

Thus, in this electron multiplier, the first plate-shaped member contributes to the formation of the first channel in the first hole portion and contributes to the formation of the second channel in the first solid area. In addition, the second plate-shaped member contributes to the formation of the first channel in the second solid area and contributes to the formation of the second channel in the second hole portion. Therefore, it is possible to perform multi-channelization while suppressing an increase in dead space, as compared with a case in which a single channel is formed using a pair of blocks.

In the electron multiplier according to an aspect of the present invention, the first plate-shaped member may include a plurality of first hole portion areas and a plurality of first solid areas arranged in a third direction intersecting the first direction and the second direction, and the second plate-shaped member may include a plurality of second hole portion areas and a plurality of second solid areas arranged in the third direction. In this case, it is possible to form a plurality of first channels and a plurality of second channels arranged in the third direction.

In the electron multiplier according to an aspect of the present invention, the main body portion may include a plurality of first plate-shaped members and a plurality of second plate-shaped members, and the first plate-shaped members and the second plate-shaped members may be alternately stacked in the second direction. In this case, it is possible to form a plurality of first channels and a plurality of second channels arranged in the second direction.

In the electron multiplier according to an aspect of the present invention, a third hole portion that reaches the first back surface from the first front surface and extends from the one end surface to be connected to the first hole portion may be provided in the first plate-shaped member, a fourth hole portion that reaches the second back surface from the second front surface and extends from the one end surface to be connected to the second hole portion may be provided in the second plate-shaped member, and the third hole portion and the fourth hole portion may overlap each other in the second direction. In this case, respective electron incidence portions of the first channel and the second channel are formed by the third hole portion and the fourth hole portion. In particular, here, the electron incidence portions of the first channel and the second channel overlap each other. Therefore, it is possible to reduce a dead space between the electron incidence portions.

In the electron multiplier according to an aspect of the present invention, each of the first hole portion and the second hole portion may include a first portion extending along the first direction and a second portion extending along a direction intersecting the first direction. In this case, it is possible to improve a gain by lengthening the first channel and the second channel. Further, in this case, ion feedback in the first channel and the second channel is suppressed by the respective second portions of the first hole portion and the second hole portion.

In the electron multiplier according to an aspect of the present invention, a resistive layer and a secondary electron multiplication layer are formed in this order on an inner surface of the first hole portion, a surface facing the inside of the first hole portion in the second solid area, an inner surface of the second hole portion, and a surface facing the inside of the second hole portion in the first solid area.

In the electron multiplier according to an aspect of the present invention, the first plate-shaped member and the second plate-shaped member may be conductors, and an insulating film may be formed between the resistive layer and the inner surface of the first hole portion, the surface facing the inside of the first hole portion in the second solid area, the inner surface of the second hole portion, and the surface facing the inside of the second hole portion in the first solid area.

A photomultiplier tube according to an aspect of the present invention includes any one of these electron multipliers; a tube body that accommodates the electron multiplier; a photoelectric surface that is provided in the tube body to face openings of the first channel and the second channel at the one end surface and supplies photoelectrons to the first channel and the second channel; and an anode that is arranged in the tube body to face openings of the first channel and the second channel at the other end surface and receives secondary electrons that are emitted from the first channel and the second channel.

A photomultiplier tube according to an aspect of the present invention includes any one of these electron multipliers; a photoelectric surface that is provided to close openings of the first channel and the second channel at the one end surface and supplies photoelectrons to the first channel and the second channel; and an anode that is provided to close openings of the first channel and the second channel at the other end surface and receives secondary electrons that are emitted from the first channel and the second channel.

Such a photomultiplier tube includes the electron multipliers described above. Therefore, it is possible to perform multi-channelization while suppressing an increase in dead space.

Advantageous Effects of Invention

According to an aspect of the present invention, it is possible to provide an electron multiplier and a photomultiplier tube capable of performing multi-channelization while suppressing an increase in dead space.

DESCRIPTION OF EMBODIMENTS

Figure 1:
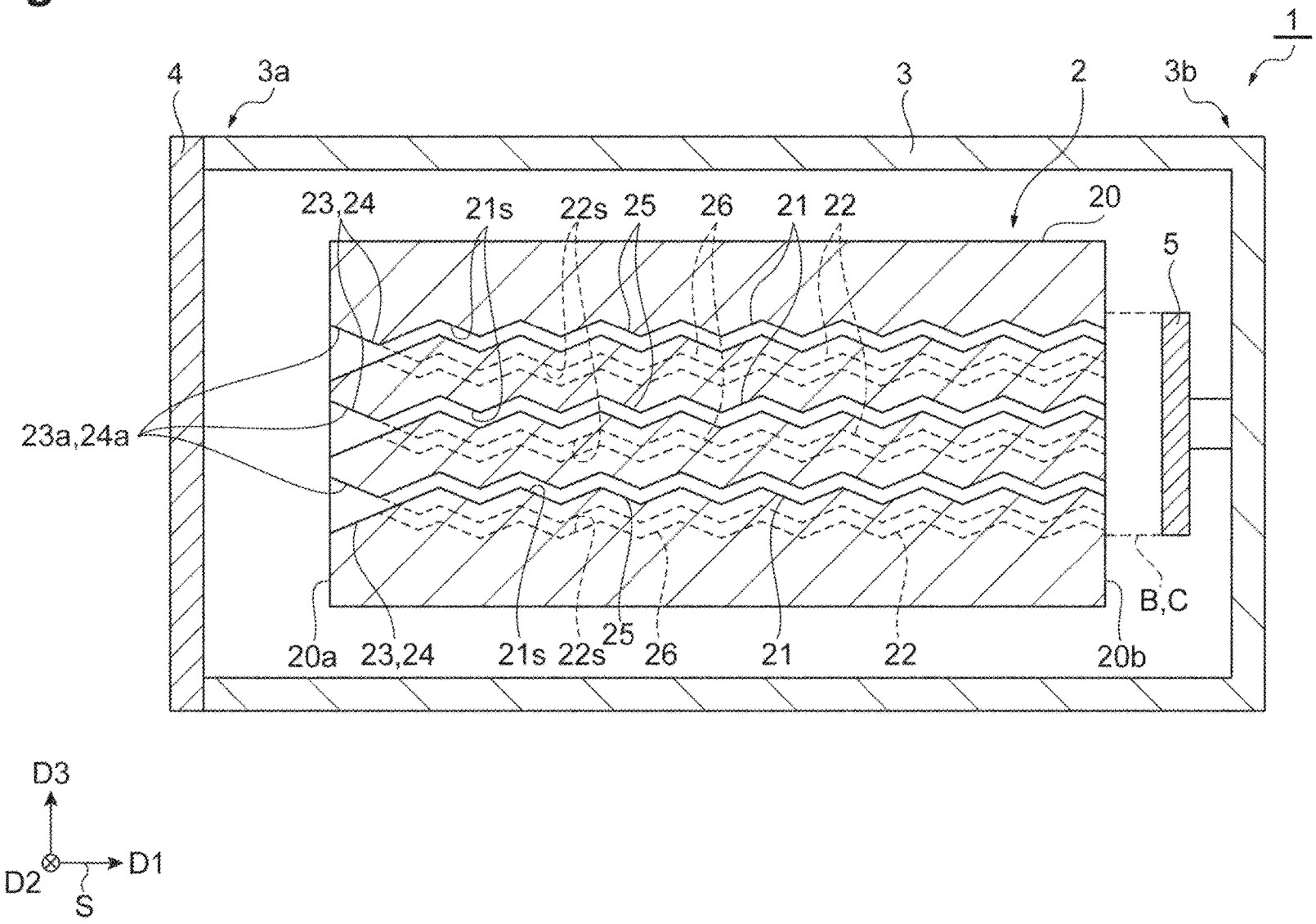
FIG. 1 is a schematic cross-sectional view of a photomultiplier tube according to an embodiment.

Hereinafter, an embodiment of an aspect of the present invention will be described in detail with reference to the drawings. It should be noted that in each drawing, the same or equivalent elements are denoted by the same reference numerals, and repeated description thereof may be omitted. In addition, in each drawing, a Cartesian coordinate system S defining a first direction D1, a second direction D2, and a third direction D3 may be shown.

Figure 2:
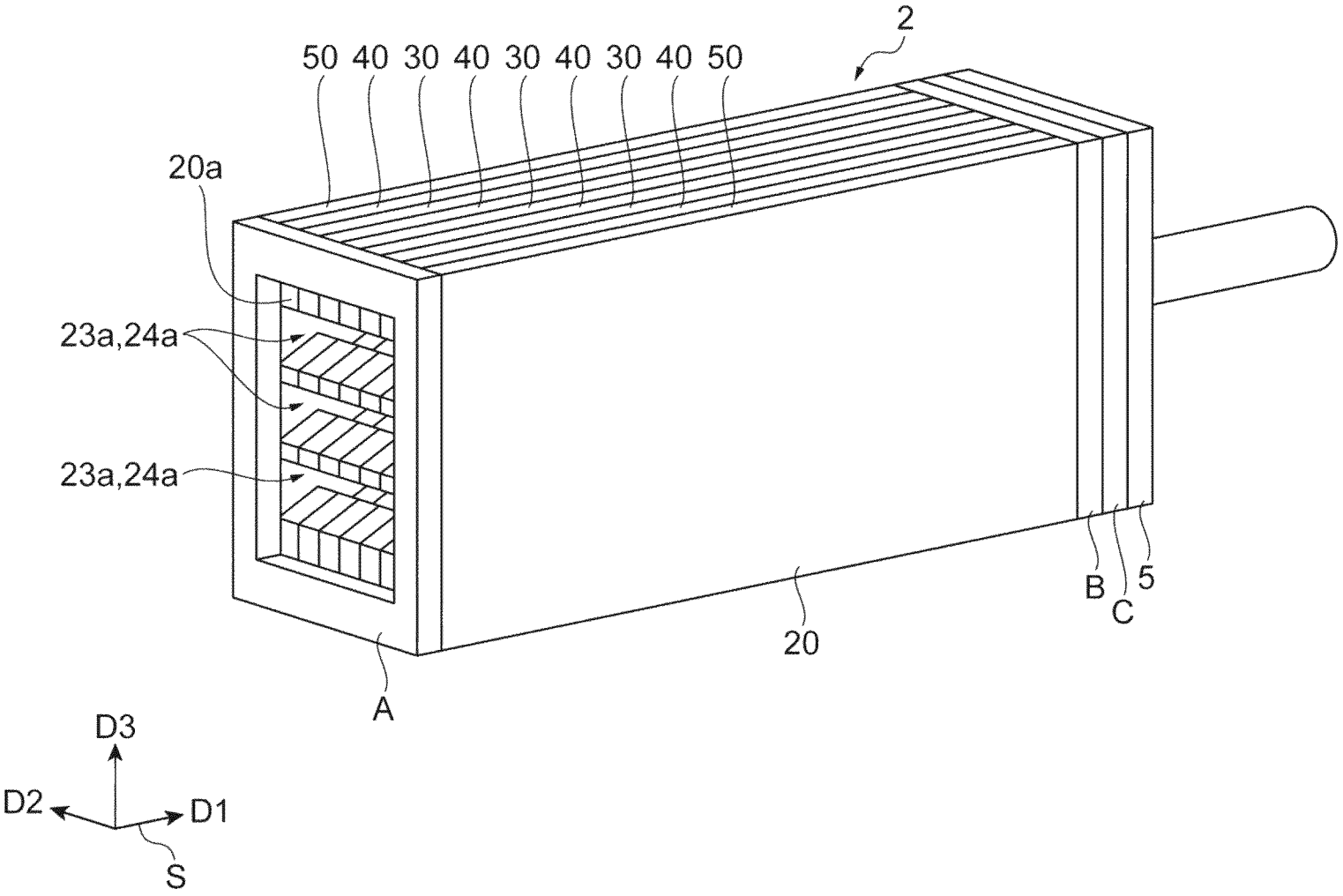
FIG. 2 is a perspective view of an electron multiplier illustrated in FIG. 1.
Figure 3:
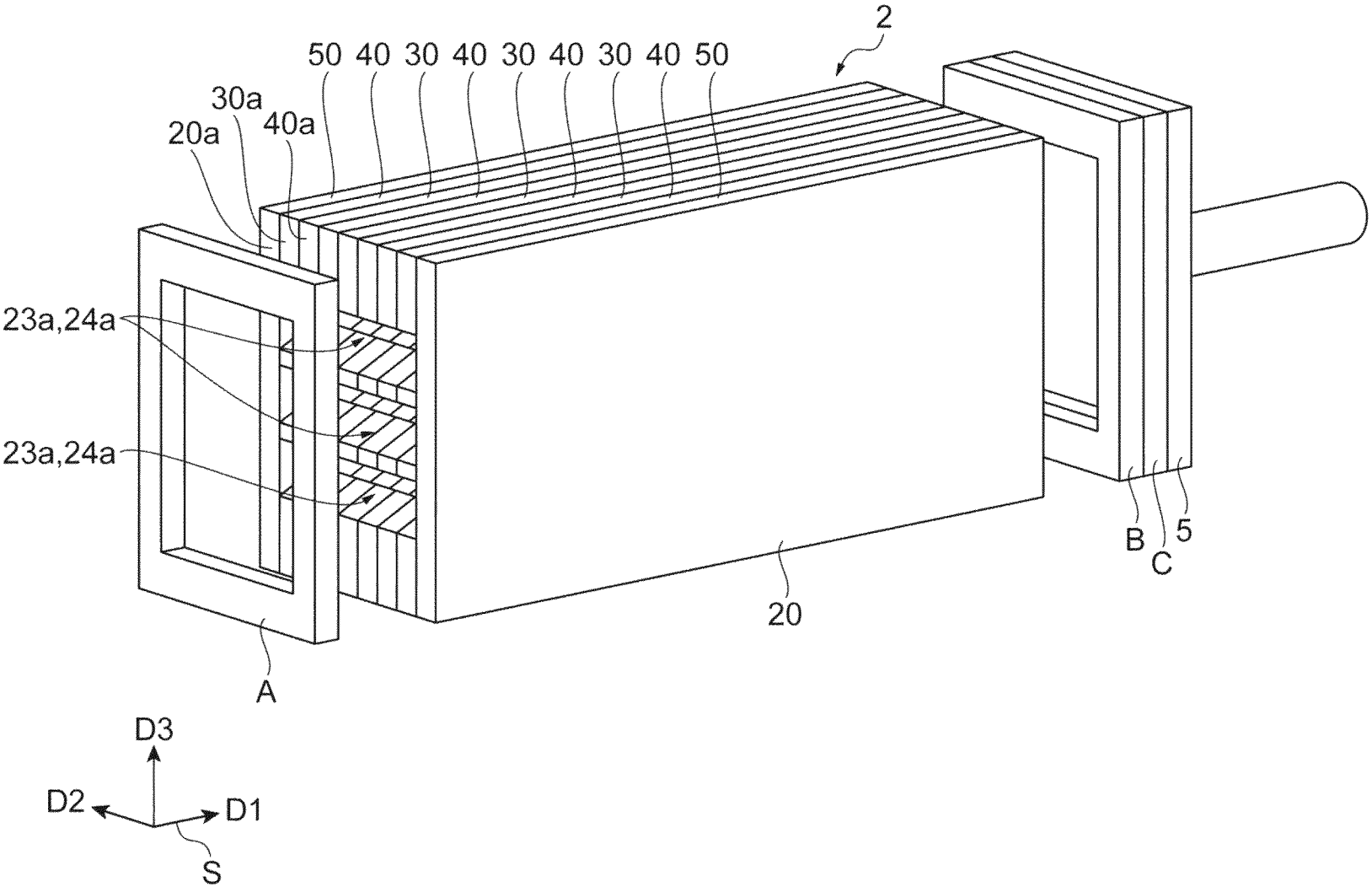
FIG. 3 is a perspective view of the electron multiplier illustrated in FIG. 1.

FIG. 1 is a schematic sectional view of a photomultiplier tube according to the present embodiment. FIGS. 2 and 3 are perspective views of an electron multiplier illustrated in FIG. 1. As illustrated in FIGS. 1 to 3, the photomultiplier tube 1 includes an electron multiplier (a channel electron multiplier CEM) 2, a tube body 3, a photoelectric surface 4, and an anode 5. The electron multiplier 2 includes a rectangular parallelepiped main body portion 20 extending along the first direction D1. The main body portion 20 is made of, for example, an insulator such as a ceramic. The main body portion 20 includes an end surface (one end surface) 20*a* in the first direction D1 and an end surface (the other end surface) 20*b* opposite to the end surface 20*a* in the first direction D1.

A rectangular annular input electrode A along an outer edge of the end surface 20*a* is provided on the end surface 20*a*. A rectangular annular output electrode B along an outer edge of the end surface 20*b* is provided on the end surface 20*b*. A potential difference along the first direction D1 is given to the entire main body portion 20 by the input electrode A and the output electrode B so that the end surface 20*b* reaches a potential relatively higher than the end surface 20*a*.

The electron multiplier 2 includes a plurality of first channels 21 and a plurality of second channels 22. That is, the photomultiplier tube 1 and the electron multiplier 2 are multi-channeled. The first channel 21 and the second channel 22 are open to the end surfaces 20*a* and 20*b* of the main body portion 20. That is, the first channel 21 and the second channel 22 extend from the end surface 20*a* to the end surface 20*b* of the main body portion 20.

The first channel 21 includes an electron incidence portion 23 and an electron multiplication portion 25. The electron incidence portion 23 includes an opening portion 23*a* that opens to the end surface 20*a*. The electron incidence portion 23 is connected to the electron multiplication portion 25 at an end portion opposite to the opening portion 23*a*. The electron multiplication portion 25 extends in the first direction D1 from a portion for connection to the electron incidence portion 23, reaches the end surface 20*b*, and is open to the end surface 20*b*. The first channel 21 emits secondary electrons in the electron multiplication portion 25 according to electrons incident from the electron incidence portion 23.

The second channel 22 includes an electron incidence portion 24 and an electron multiplication portion 26. The electron incidence portion 24 includes an opening portion 24*a* that opens to the end surface 20*a*. The electron incidence portion 24 is connected to the electron multiplication portion 26 at an end portion opposite to the opening portion 24*a*. The electron multiplication portion 26 extends in the first direction D1 from a portion for connection to the electron incidence portion 24, reaches the end surface 20*b*, and is open to the end surface 20*b*. The second channel 22 emits secondary electrons in the electron multiplication portion 26 according to electrons incident from the electron incidence portion 24.

The first channel 21 and the second channel 22 overlap each other at the electron incidence portion 23 and the electron incidence portion 24 in the second direction D2 (a stacking direction of a plate-shaped member to be described below, which is a direction crossing (orthogonal to) the first direction D1), and do not overlap each other at the electron multiplication portion 25 and the electron multiplication portion 26 (are spaced from each other in the third direction D3). It should be noted that the third direction D3 is a direction crossing (orthogonal to) the first direction D1 and the second direction D2.

The tube body 3 accommodates the electron multiplier 2. One end portion 3*a* of the tube body 3 in the first direction D1 is open and the other end portion 3*b* is sealed. The electron multiplier 2 is accommodated in the tube body 3 so that the end surface 20*a* of the main body portion 20 is located on the side of the end portion 3*a* of the tube body 3.

The photoelectric surface 4 generates photoelectrons according to incidence of light. The photoelectric surface 4 is provided on the tube body 3 to face the opening portion (opening) 23*a* of the first channel 21 and the opening portion (opening) 24*a* of the second channel 22 in the end surface 20*a*. Here, the photoelectric surface 4 is provided on the tube body 3 to seal the end portion 3*a* of the tube body 3. The photoelectric surface 4 supplies the photoelectrons to the first channel 21 and the second channel 22 via the electron incidence portions 23 and 24.

The anode 5 is arranged inside the tube body 3 to face the openings of the first channel 21 and the second channel 22 (the openings of the electron multiplication portions 25 and 26) in the end surface 20*b*. Here, the anode 5 is attached to the output electrode B via an insulating layer C having a rectangular annular shape. A central portion of the anode 5 is exposed from opening portions of the output electrode B and the insulating layer C and faces the openings of the first channel 21 and the second channel 22. With such a configuration, the anode 5 receives the secondary electrons emitted from the first channel 21 and the second channel 22 via the electron multiplication portions 25 and 26. A detector (not illustrated) that detects pulses of an electric signal corresponding to the secondary electrons received by the anode 5, for example, is connected to the anode 5.

Figure 4:
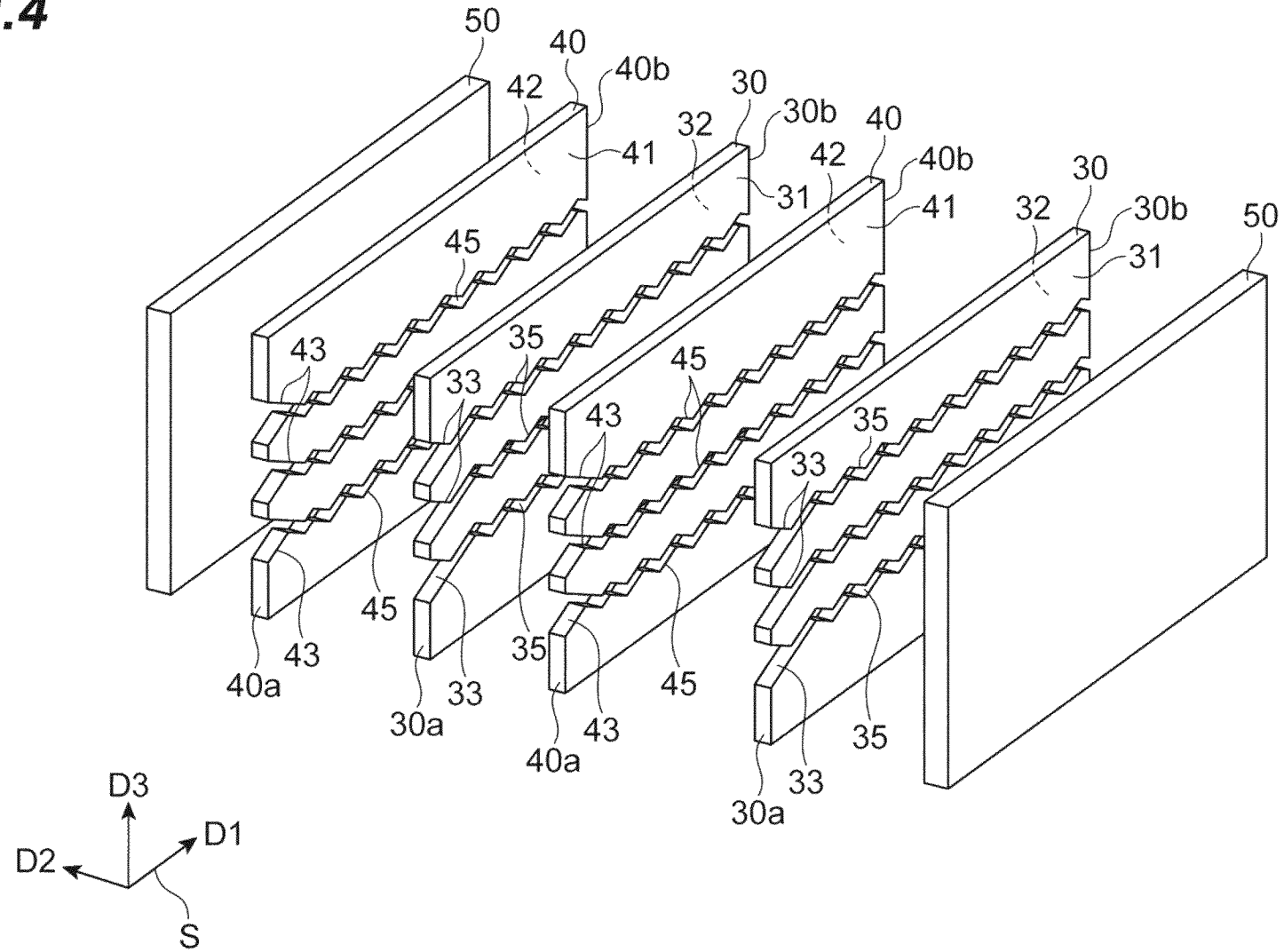
FIG. 4 is an exploded perspective view of the electron multiplier illustrated in FIGS. 2 and 3.

Here, FIG. 4 is an exploded perspective view of the electron multiplier illustrated in FIGS. 2 and 3. As illustrated in FIGS. 2 to 4, the main body portion 20 of the electron multiplier 2 is configured by stacking a plurality of plate-shaped members on each other. Here, the main body portion 20 includes a plurality of first plate-shaped members 30, a plurality of second plate-shaped members 40, and a pair of third plate-shaped members 50, which are stacked on each other in the second direction D2. The first plate-shaped members 30, the second plate-shaped members 40, and the third plate-shaped members 50 form the first channel 21 and the second channel 22. The number of first plate-shaped members 30 and second plate-shaped members 40 can be arbitrarily set according to the number of required channels and is, for example, about two to four.

The first plate-shaped member 30 and the second plate-shaped member 40 are alternately stacked in the second direction D2. The third plate-shaped member 50 is stacked together with the first plate-shaped members 30 and the second plate-shaped members 40 to sandwich the stack of the first plate-shaped members 30 and the second plate-shaped members 40 from both sides in the second direction D2. Therefore, some of the plurality of first plate-shaped members 30 can be arranged between a pair of second plate-shaped members 40 and the others can be arranged between the second plate-shaped member 40 and the third plate-shaped member 50. Further, some of the plurality of second plate-shaped members 40 can be arranged between a pair of first plate-shaped members 30 and the others can be arranged between the first plate-shaped member 30 and the third plate-shaped member 50. Aspects of the arrangement of the first plate-shaped members 30 and the second plate-shaped members 40 may differ according to the number of first plate-shaped members 30 and the second plate-shaped members 40, for example.

In the example of FIG. 4, one first plate-shaped member 30 on the center side in the second direction D2 among two first plate-shaped members 30 is arranged between a pair of second plate-shaped members 40, and one first plate-shaped member 30 on the outer side in the second direction D2 among the two first plate-shaped members 30 is arranged between the second plate-shaped member 40 and the third plate-shaped member 50. Further, in the example of FIG. 4, one second plate-shaped member 40 on the center side in the second direction D2 among two second plate-shaped members 40 is arranged between a pair of first plate-shaped members 30, and one second plate-shaped member 40 on the outer side in the second direction D2 among the two second plate-shaped members 40 is arranged between the first plate-shaped member 30 and the third plate-shaped member 50.

Figure 5:
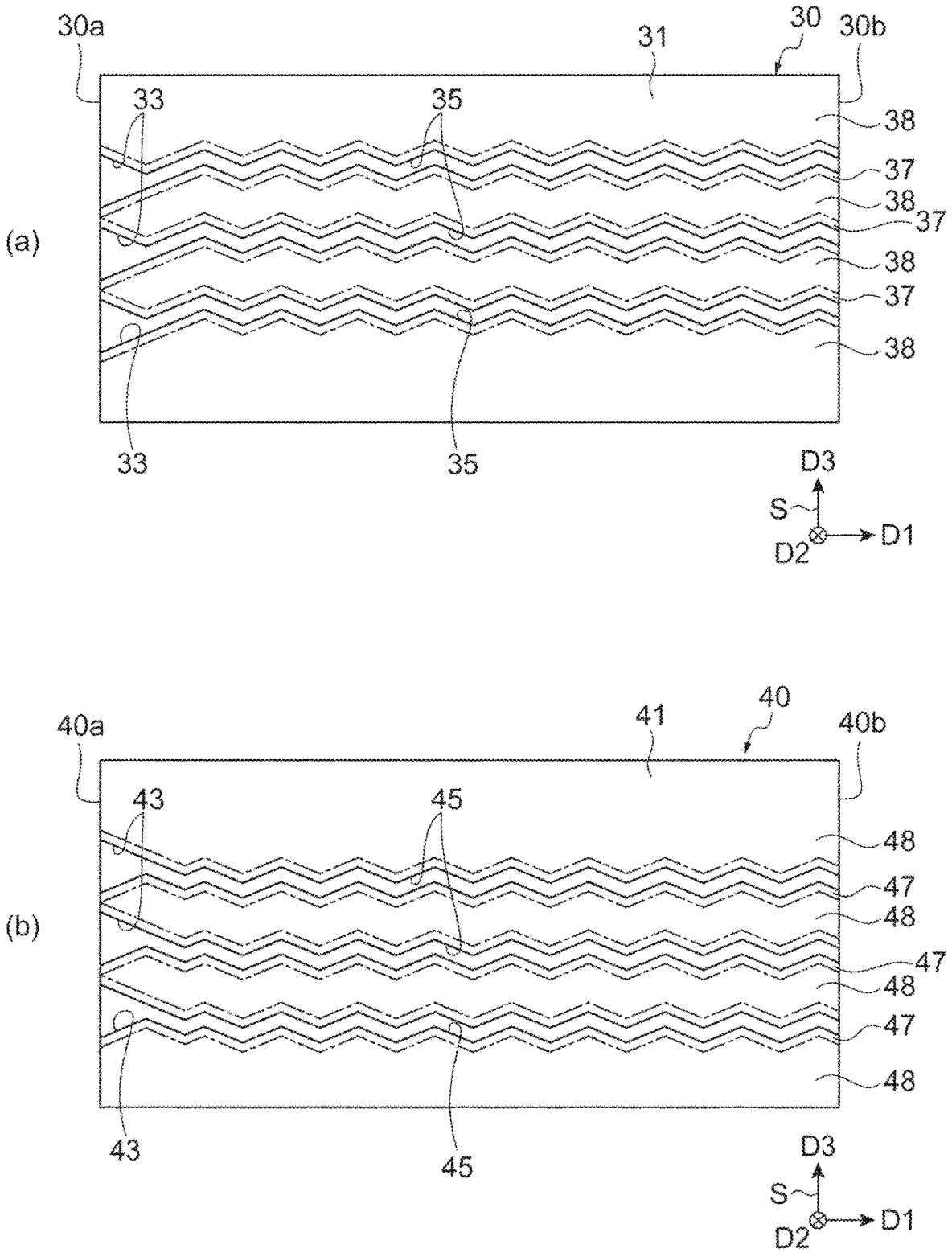
FIG. 5 is a plan view of a first plate-shaped member and a second plate-shaped member illustrated in FIG. 4.

FIG. 5 is a plan view of the first plate-shaped member and the second plate-shaped member illustrated in FIG. 4. As illustrated in FIGS. 4 and 5, the first plate-shaped member 30, the second plate-shaped member 40, and the third plate-shaped member 50 have a rectangular plate shape of which a longitudinal direction is the first direction D1 and a thickness direction is the second direction D2. The first plate-shaped member 30 includes a front surface (a first front surface) 31 and a back surface (a first back surface) 32 that intersect the second direction D2. In the first plate-shaped member 30, holes defining the first channels 21 are formed.

More specifically, in the first plate-shaped member 30, a hole portion (a third hole portion) 33 and a hole portion (a first hole portion) 35 reaching the back surface 32 from the front surface 31 are formed. The hole portion 33 reaches the end surface 30*a* of the first plate-shaped member 30 in the first direction D1. The hole portion 33 has a tapered shape that decreases in size in the first direction D1 from the end surface 30*a*. The hole portion 33 is connected to the hole portion 35. The hole portion 35 extends in a wave shape along the first direction D1 from a portion for connection with the hole portion 33 and reaches the end surface 30*b* of the first plate-shaped member 30 in the first direction D1.

The end surface 30*a* is a surface on which the end surface 20*a* of the main body portion 20 is formed. The end surface 30*b* is a surface on which the end surface 20*b* of the main body portion 20 is formed. Therefore, the hole portion 33 corresponds to the electron incidence portion 23 of the first channel 21 (defines the electron incidence portion 23), and the hole portion 35 corresponds to the electron multiplication portion 25 of the first channel 21 (defines the electron multiplication portion 25).

Here, a plurality (three in this case) of hole portions 33 and 35 arranged in the third direction D3 are foil led in the first plate-shaped member 30. An area between the hole portions 35 in the first plate-shaped member 30 and an area outside the hole portion 35 are solid. That is, the first plate-shaped member 30 includes a plurality of hole portion areas (first hole portion areas) 37 in which the hole portions 35 are formed and a plurality of solid areas (first solid areas) 38 adjacent to the hole portion areas 37. Here, the hole portion area 37 has a shape along the hole portion 35. In addition, here, the solid area 38 has a shape complementary to the hole portion 35. The hole portion areas 37 and the solid areas 38 are alternately arranged in the third direction D3.

The second plate-shaped member 40 includes a front surface (a second front surface) 41 and a back surface (a second back surface) 42 that intersect the second direction D2. Holes defining the second channels 22 are formed in the second plate-shaped member 40. More specifically, a hole portion (a fourth hole portion) 43 and a hole portion (a second hole portion) 45 reaching the back surface 42 from the front surface 41 are forming in the second plate-shaped member 40. The hole portion 43 reaches an end surface 40*a* of the second plate-shaped member 40 in the first direction D1. The hole portion 43 has a tapered shape that decreases in size in the first direction D1 from the end surface 40*a*. The hole portion 43 is connected to the hole portion 45.

The hole portion 45 extends in a wave shape along the first direction D1 from a portion for connection with the hole portion 43 and reaches the end surface 40*b* of the second plate-shaped member 40 in the first direction D1. The end surface 40*a* is a surface on which the end surface 20*a* of the main body portion 20 is formed. The end surface 40*b* is a surface on which the end surface 20*b* of the main body portion 20 is formed. Therefore, the hole portion 43 corresponds to the electron incidence portion 24 of the second channel 22 (defines the electron incidence portion 24), and the hole portion 45 corresponds to the electron multiplication portion 26 of the second channel 22 (defines the electron multiplication portion 26).

Here, a plurality (three in this case) of hole portions 43 and 45 arranged in the third direction D3 are formed in the second plate-shaped member 40. An area between the hole portions 45 in the second plate-shaped member 40 and an area outside the hole portion 45 are solid. That is, the second plate-shaped member 40 includes a plurality of hole portion areas (second hole portion areas) 47 in which the hole portions 45 are formed, and a plurality of solid areas (second solid areas) 48 adjacent to the hole portion areas 47). Here, the hole portion area 47 has a shape along the hole portion 45. In addition, here, the solid area 48 has a shape complementary to the hole portion 45. The hole portion areas 47 and the solid areas 48 are alternately arranged in the third direction D3. It should be noted that, a boundary of each area indicated by a single dot-dashed line in FIG. 5 is virtual one.

The hole portion area 37 of the first plate-shaped member 30 faces the solid area 48 of the second plate-shaped member 40 in the second direction D2. Further, the hole portion area 47 of the second plate-shaped member 40 faces the solid area 38 of the first plate-shaped member 30 in the second direction D2. That is, when viewed in the second direction D2, the hole portion 35 and the hole portion 45 do not overlap each other (the hole portion 35 and the hole portion 45 are spaced from each other in the third direction D3). Therefore, the opening in the second direction D2 of the hole portion 35 of the first plate-shaped member 30 is closed by the solid areas 48 of a pair of second plate-shaped members 40 or closed by the solid area 48 of the second plate-shaped member 40 and the third plate-shaped member 50.

Further, the opening in the second direction D2 of the hole portion 45 of the second plate-shaped member 40 is closed by the solid areas 38 of a pair of first plate-shaped members 30 or is closed by the solid area 38 of the first plate-shaped member 30 and the third plate-shaped member 50. Further, the openings of the hole portions 33 and 43 in the second direction D2 are continuous between the plurality of first plate-shaped members 30 and the second plate-shaped members 40 and are closed by a pair of third plate-shaped members 50.

Therefore, the first channel 21 (the electron multiplication portion 25 in this case) is formed to include at least an inner surface of the hole portion 35 and a surface facing the inside of the hole portion 35 in the solid area 48. More specifically, the first channel 21 on the center side of the main body portion 20 in the second direction D2 is formed of the inner surface of the hole portion 35 and the surface facing the inside of the hole portion 35 in a pair of solid areas 48. Further, the first channel 21 on the outer side of the main body portion 20 in the second direction D2 is formed of the inner surface of the hole portion 35, the surface facing the inside of the hole portion 35 in the solid area 48, and the surface facing the inside of the hole portion 35 in the third plate-shaped member 50.

Further, the second channel 22 (the electron multiplication portion 26 in this case) is formed to include at least an inner surface of the hole portion 45 and a surface facing the inside of the hole portion 45 in the solid area 38. More specifically, the second channel 22 on the center side of the main body portion 20 in the second direction D2 is formed of the inner surface of the hole portion 45 and the surface facing the inside of the hole portion 45 in a pair of solid areas 38. Further, the second channel 22 on the outer side of the main body portion 20 in the second direction D2 is faulted of the inner surface of the hole portion 45, the surface facing the inside of the hole portion 45 in the solid area 38, and the surface facing the inside of the hole portion 45 in the third plate-shaped member 50.

Here, the main body portion 20 includes the plurality of first plate-shaped members 30 and second plate-shaped members 40 arranged in the second direction D2, as described above. The plurality of hole portions 33 and 35 arranged in the third direction D3 are formed in the first plate-shaped member 30. The plurality of hole portions 43 and 45 arranged in the third direction D3 are formed in the second plate-shaped member 40. Therefore, the electron multiplier 2 includes a plurality of channels (the first channels 21 and the second channels 22) arranged two-dimensionally in the second direction D2 and the third direction D3.

Here, the inner surface of the hole portion 35, the surface facing the inside of the hole portion 35 in the solid area 48, and the surface facing the inside of the hole portion 35 in the third plate-shaped member 50 form an inner surface 21*s* of the first channel 21 (see FIG. 1). Further, the inner surface of the hole portion 45, the surface facing the inside of the hole portion 45 in the solid area 38, and the surface facing the inside of the hole portion 45 in the third plate-shaped member 50 fault an inner surface 22*s* of the second channel 22 (see FIG. 1). A resistive layer and a secondary electron multiplication layer are formed in this order on the inner surfaces 21*s* and 22*s*.

As a material of the resistive layer, for example, a film of a mixture of $Al_2O_3$ (aluminum oxide) and ZnO (zinc oxide), a film of a mixture of $Al_2O_3$ and $TiO_2$ (titanium dioxide), or the like can be used. Further, as a material of the secondary electron multiplication layer, for example, $Al_2O_3$, MgO (magnesium oxide), or the like can be used. The resistive layer and the secondary electron multiplication layer are formed using, for example, atomic layer deposition (ALD).

Figure 6:
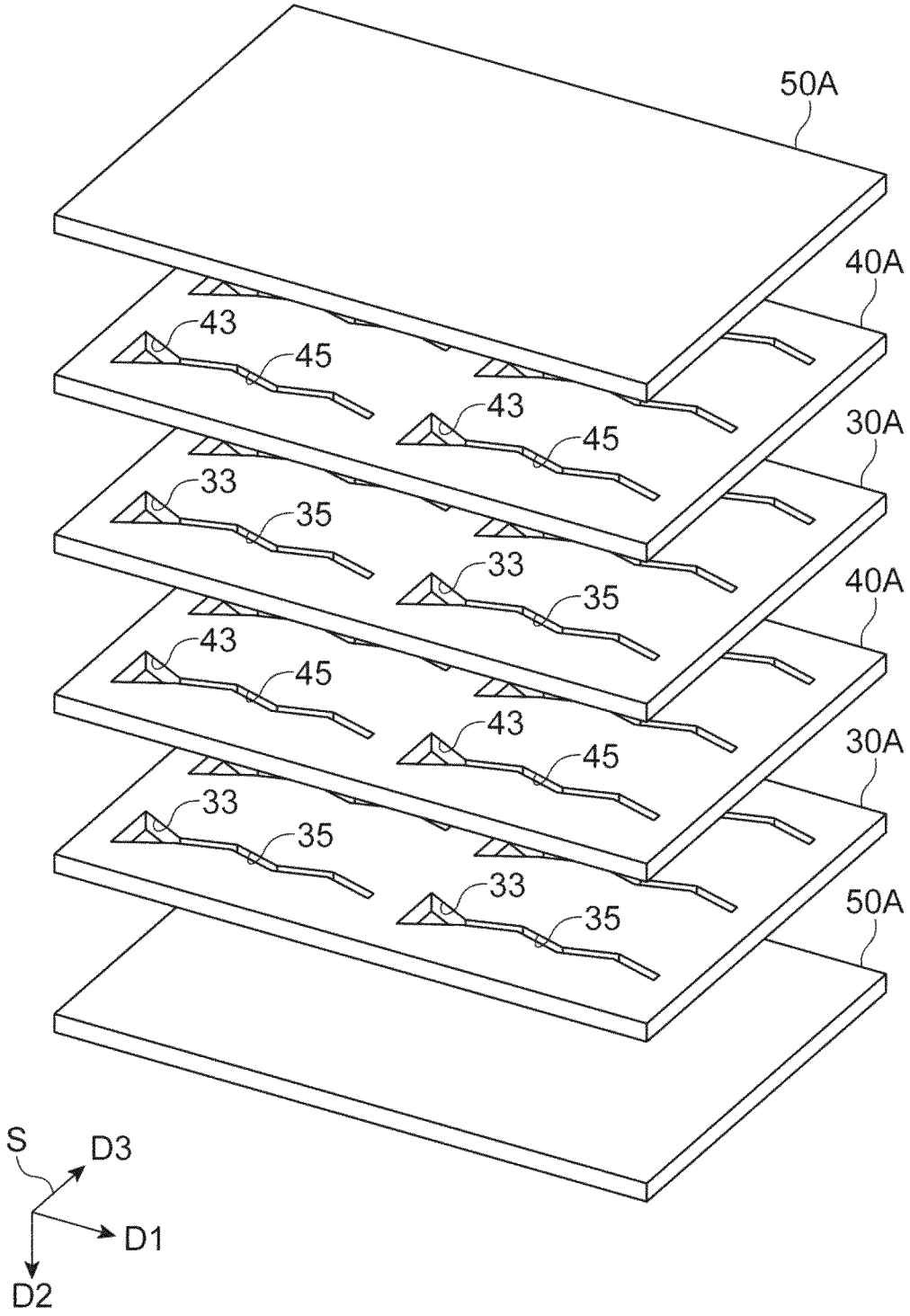
FIG. 6 is a diagram illustrating respective processes of a method of manufacturing the electron multiplier illustrated in FIG. 1.

Next, an example of a method of manufacturing the electron multiplier 2 will be described. FIGS. 6 to 9 are diagrams illustrating respective processes of the method of manufacturing the electron multiplier illustrated in FIG. 1. As illustrated in FIG. 6, in this method, a plurality of plate-shaped members 30A for the first plate-shaped member 30, a plurality of plate-shaped members 40A for the second plate-shaped member 40, and a pair of plate-shaped members 50A for the third plate-shaped member 50 are first prepared. The plate-shaped members 30A, 40A, and 50A include portions formed of a plurality of (two in this case) first plate-shaped members 30, second plate-shaped members 40, and third plate-shaped members 50 arranged in the first direction D1, respectively.

A plurality of hole portions 33, 35, 43, and 45 are forming in the plate-shaped members 30A and 40A by, for example, laser processing or punching using a die. Here, the hole portions 33, 35, 43, and 45 are formed not to reach the end portions of the plate-shaped members 30A and 40A.

Figure 7:
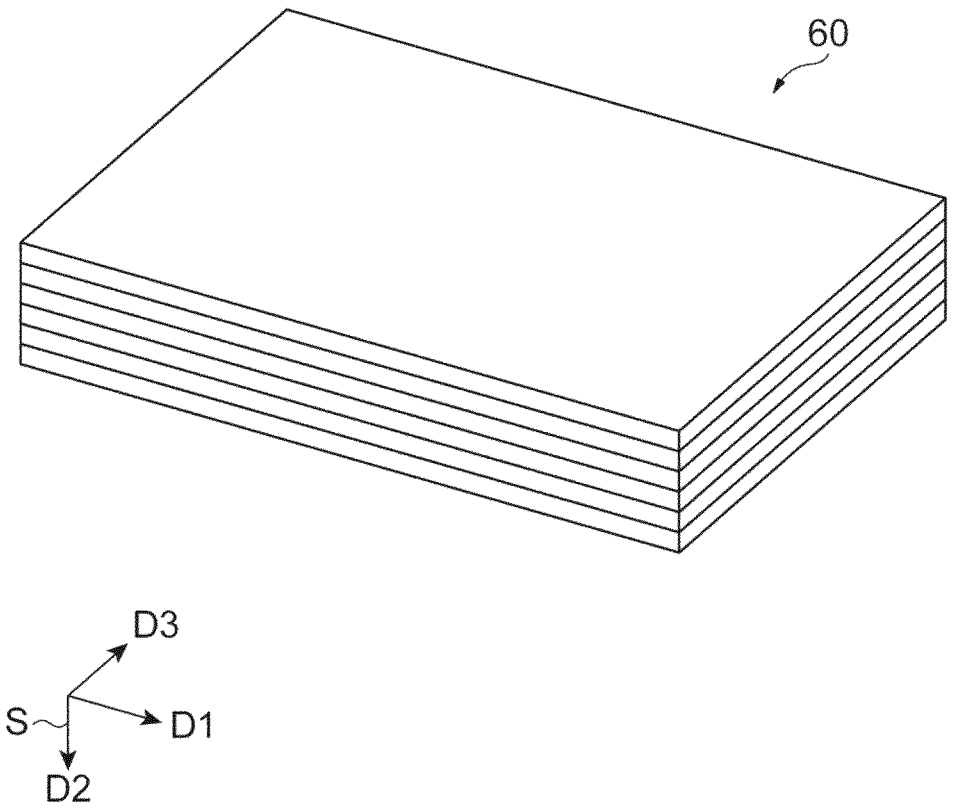
FIG. 7 is a diagram illustrating respective processes of a method of manufacturing the electron multiplier illustrated in FIG. 1.

Subsequently, the plate-shaped member 30A and the plate-shaped member 40A are alternately stacked in the second direction D2, and the plate-shaped members 50A are arranged so that the stack of the plate-shaped members 30A and 40A is sandwiched from both sides in the second direction D2. Accordingly, a stack 60 configured of the plate-shaped members 30A, 40A and 50A is formed as illustrated in FIG. 7. In this state, the stack 60 is pressed and sintered so that the plate-shaped members 30A, 40A, and 50A are integrated with each other. Accordingly, a plurality of (two in this case) main body portions 20 arranged in the first direction D1 are formed in the stack 60.

Figure 8:
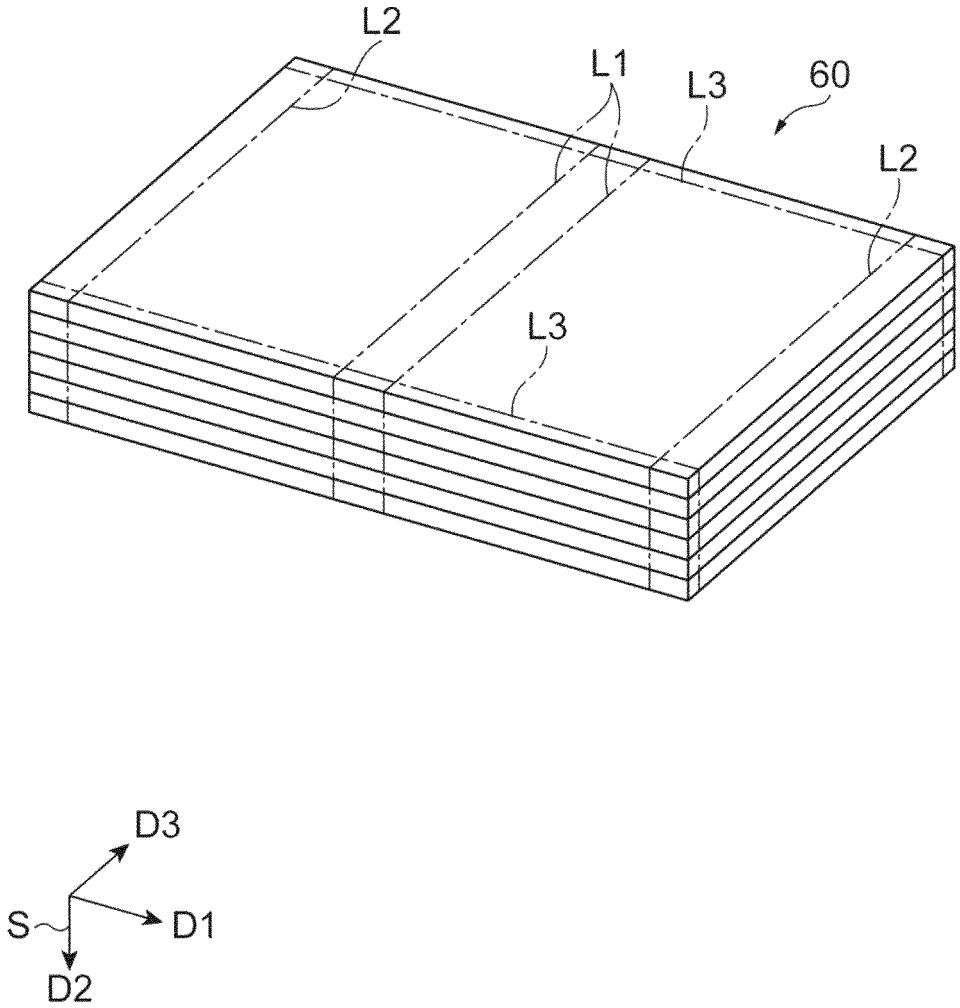
FIG. 8 is a diagram illustrating respective processes of a method of manufacturing the electron multiplier illustrated in FIG. 1.
Figure 9:
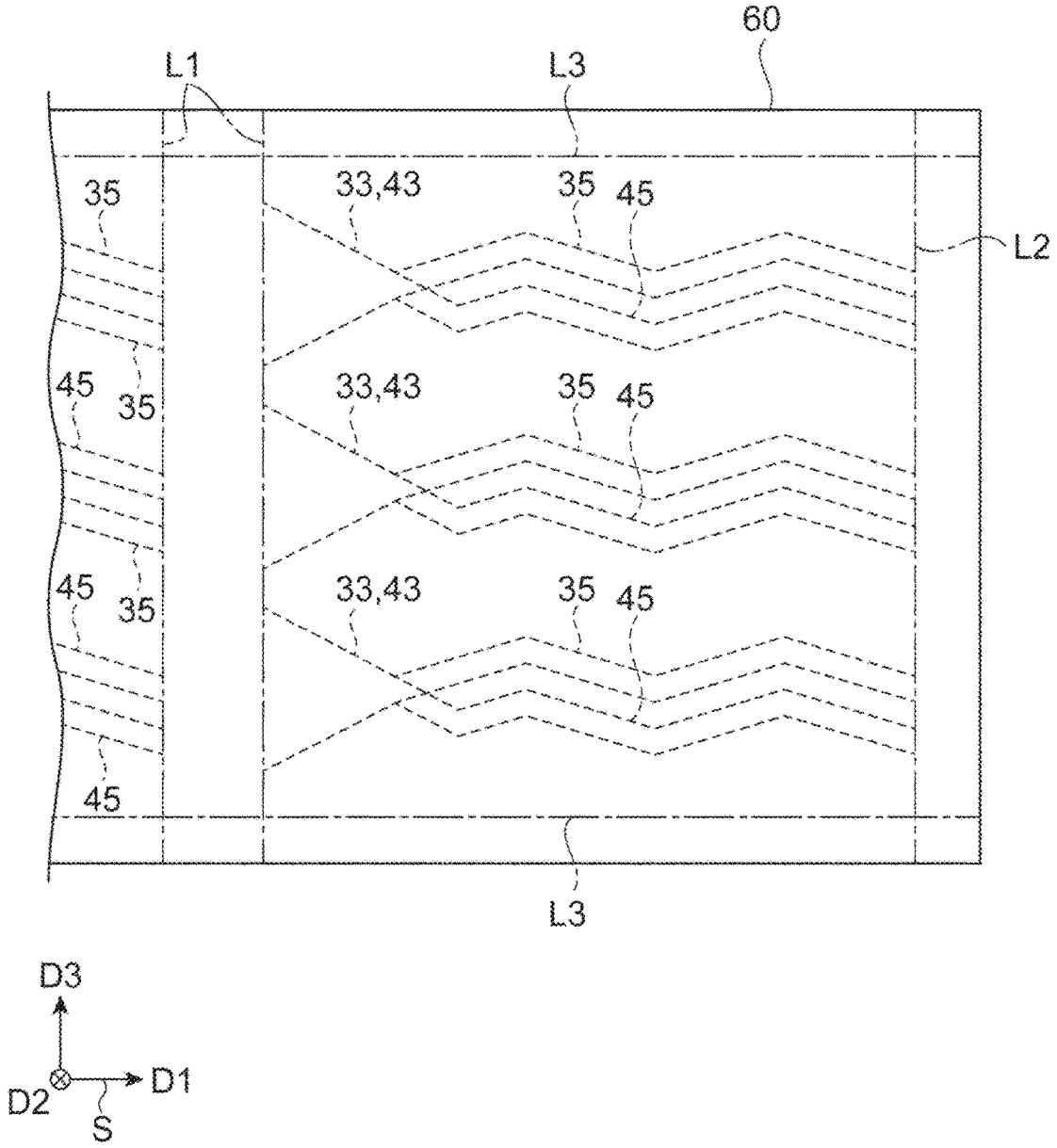
FIG. 9 is a diagram illustrating respective processes of a method of manufacturing the electron multiplier illustrated in FIG. 1.

In the subsequent process, the integrated stack 60 is cut so that a plurality of (two in this case) main body portions 20 are cut out, as illustrated in FIGS. 8 and 9. In this process, virtual scheduled cutting lines L1, L2, and L3 are first set. The scheduled cutting lines L1 extend linearly in the third direction D3 to pass between the main body portions 20. The scheduled cutting lines L2 extend linearly along both edge portions of the stack 60 in the first direction D1. The scheduled cutting lines L3 extend linearly along both edge portions of the stack 60 in the third direction D3.

The scheduled cutting lines L1 are set such that the hole portions 33 and 43 are opened at cut surfaces when the cutting along the scheduled cutting lines L1 has been performed. In addition, the scheduled cutting lines L2 are set such that the hole portions 35 and 45 are opened at cut surfaces when cutting along the scheduled cutting line L2 has been performed. Therefore, by cutting the stack 60 along the scheduled cutting lines L1, L2, and L3, a plurality of (two in this case) first plate-shaped members 30, second plate-shaped members 40, and third plate-shaped members 50 are formed from the respective plate-shaped members 30A, 40A, and 50A, and a plurality of (two in this case) main body portions 20 are cut out from the stack 60.

In the subsequent process, in the respective main body portions 20, a resistive layer and a secondary electron multiplication layer are formed using an atomic layer deposition method at least on the inner surface 21*s* of the first channel 21 and the inner surface 22*s* of the second channel 22. Accordingly, the electron multiplier 2 is manufactured.

As described above, in the electron multiplier 2, the plurality of channels including the first channels 21 and the second channels 22 are provided in the main body portion 20. The main body portion 20 includes the first plate-shaped members 30 and the second plate-shaped members 40 stacked on each other. The first plate-shaped member 30 includes the hole portion areas 37 in which the hole portions 35 are formed, and the solid areas 38 adjacent to the hole portion areas 37. The second plate-shaped member 40 includes the hole portion areas 47 in which the hole portions 45 are formed, and the solid areas 48 adjacent to the hole portion areas 47. The hole portion areas 37 of the first plate-shaped member 30 face the solid areas 48 of the second plate-shaped member 40 in the second direction D2 (the stacking direction of the plate-shaped members). The hole portion areas 47 of the second plate-shaped member 40 face the solid areas 38 of the first plate-shaped member 30 in the second direction D2.

That is, at least one opening of the hole portion 35 in the second direction D2 is closed by the solid area 48 of the second plate-shaped member 40, and at least one opening of the hole portion 45 in the second direction D2 is closed by the solid area 38 of the first plate-shaped member 30. Accordingly, the first channel 21 is formed to include the inner surface of the hole portion 35 and the surface facing the inside of the hole portion 35 in the solid area 48, and the second channel 22 is formed to include the inner surface of the hole portion 45 and the surface facing the inside of the hole portion 45 in the solid area 38.

Thus, in the electron multiplier 2, the first plate-shaped member 30 contributes to the formation of the first channel 21 in the hole portion 35 and contributes to the formation of the second channel 22 in the solid area 38. In addition, the second plate-shaped member 40 contributes to the formation of the first channel 21 in the solid area 48 and contributes to the formation of the second channel 22 in the hole portion 45. Therefore, it is possible to perform multi-channelization while suppressing an increase in dead space, as compared with a case in which a single channel is formed using a pair of blocks.

Further, in the electron multiplier 2, the first plate-shaped member 30 includes a plurality of hole portion areas 37 and a plurality of solid areas 38 arranged in the third direction D3 intersecting the first direction D1 and the second direction D2. The second plate-shaped member 40 includes a plurality of hole portion areas 47 and a plurality of solid areas 48 arranged in the third direction D3. Therefore, the plurality of first channels 21 and the plurality of second channels 22 arranged in the third direction D3 are formed.

In addition, in the electron multiplier 2, the main body portion 20 includes the plurality of first plate-shaped members 30 and the plurality of second plate-shaped members 40. The first plate-shaped members 30 and the second plate-shaped members 40 are stacked alternately in the second direction D2. Therefore, the plurality of first channels 21 and the plurality of second channels 22 arranged in the second direction D2 are formed.

Further, in the electron multiplier 2, the hole portion 33 reaching the back surface 32 from the front surface 31 and extending from the end surface 30*a* to be connected to the hole portion 35 is provided in the first plate-shaped member 30. The hole portion 43 reaching the back surface 42 from the front surface 41 and extending from the end surface 30*a* to be connected to the hole portion 45 is provided in the second plate-shaped member 40. The hole portion 33 and the hole portion 43 may overlap each other in the second direction D2. In this case, the respective electron incidence portions 23 and 24 of the first channel 21 and the second channel 22 are formed by the hole portion 33 and the hole portion 43. In particular, here, the electron incidence portions 23 and 24 of the first channel 21 and the second channel 22 overlap each other. Therefore, a dead space between the electron incidence portions 23 and 24 is reduced.

It should be noted that in this electron multiplier 2, a heat radiation path from a heat generation place within each channel to the outside is shortened due to the reduction of the dead space. Therefore, the configuration of the electron multiplier 2 contributes to suppression of temperature rise.

In addition, the photomultiplier tube 1 includes the electron multiplier 2. Therefore, it is possible to perform multi-channelization while suppressing an increase in dead space.

The embodiment of the electron multiplier and the photomultiplier tube according to an aspect of the present invention has been described. Therefore, the electron multiplier and the photomultiplier tube according to the aspect of the present invention are not limited to the electron multiplier 2 and the photomultiplier tube 1 and may be arbitrarily modified without departing from the gist of each claim.

Figure 10:
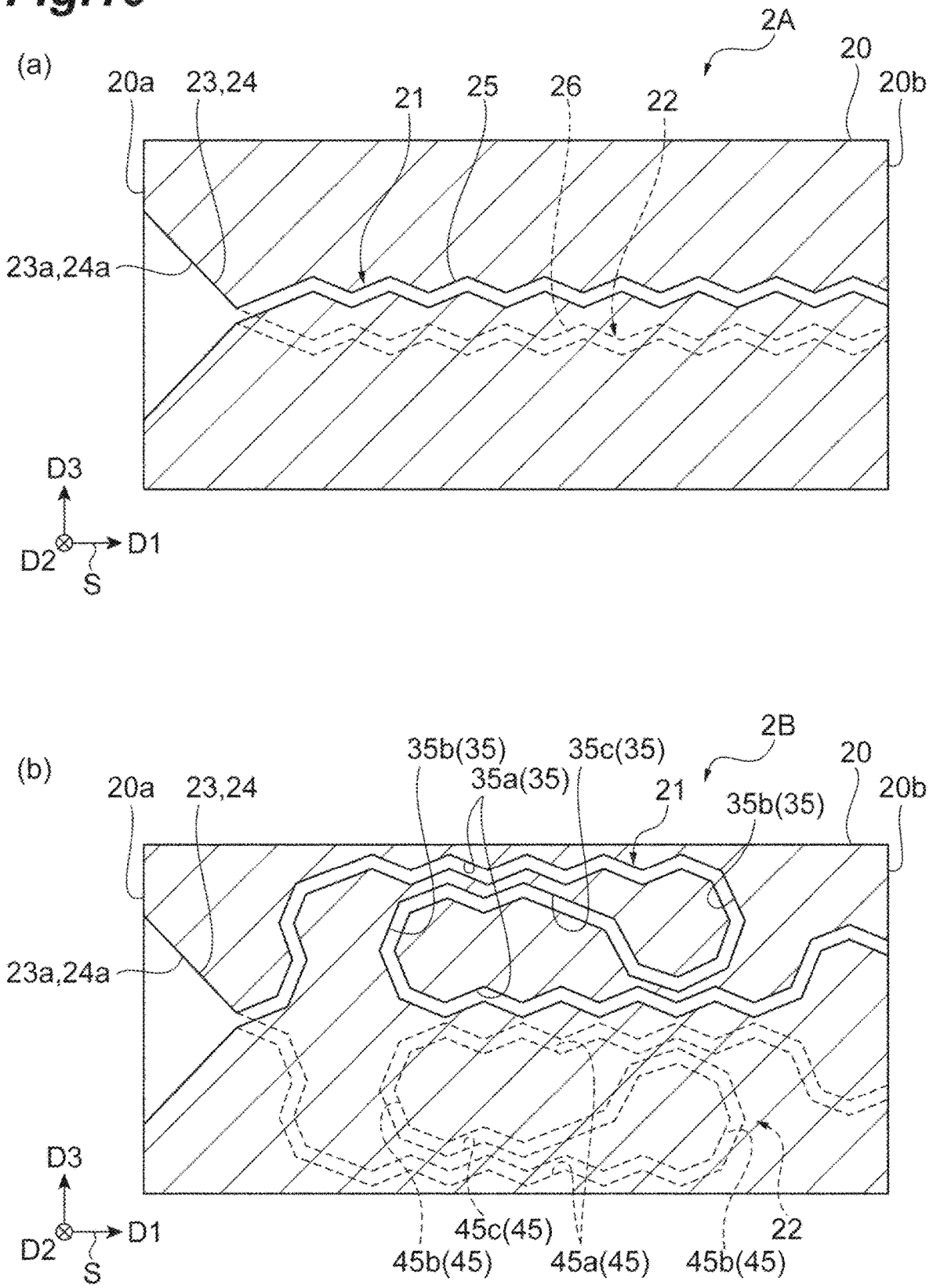
FIG. 10 is a diagram illustrating an electron multiplier according to a modification example.

FIG. 10 is a cross-sectional diagram illustrating an electron multiplier according to a modification example. An electron multiplier 2A illustrated in FIG. 10(*a*) includes a different number of channels in the third direction D3 from the electron multiplier 2. More specifically, the electron multiplier 2A includes a single first channel 21 and a single second channel 22 in the third direction D3. It should be noted that the electron multiplier 2A includes a plurality of first channels 21 and a plurality of second channels 22 in the second direction D2. According to this electron multiplier 2A, a dead space between electron incidence portions 23 and 24 in the third direction D3 is reduced compared with the case in which the plurality of first channels 21 and the second channels 22 are arranged in the third direction D3.

The electron multiplier 2B illustrated in FIG. 10(*b*) includes a single first channel 21 and a single second channel 22 in the third direction D3, similar to the electron multiplier 2A. However, in the electron multiplier 2B, the shapes of the hole portions 35 and 45 in which the first channel 21 and the second channel 22 are formed are different from those in the electron multipliers 2 and 2A.

More specifically, in the electron multiplier 2B, the hole portion 35 includes a pair of first portions 35*a* extending in the first direction D1, a pair of second portions 35*b* extending in the third direction D3 intersecting the first direction D1, and a single third portion 35*c* extending in the first direction D1. Here, one of the first portions 35*a* extends in the first direction D1 from the end surface 20*a*. Further, the other of the first portion 35*a* extends in the first direction D1 from a position partially overlapping the one first portion 35*a* in the third direction D3 and reaches the end surface 20*b*. Further, the third portion 35*c* extends in the first direction D1 between the one first portion 35*a* and the other first portion 35*a*. The second portion 35*b* extends in the third direction D3 while being bent, and connects the first portion 35*a* to the third portion 35*c*.

The hole portion 45 includes a pair of first portions 45*a* extending in the first direction D1, a pair of second portions 45*b* extending in the third direction D3 intersecting the first direction D1, and a single third portion 45*c* extending in the first direction D1. Here, one of the first portions 45*a* extends in the first direction D1 from the end surface 20*a*. Further, the other of the first portions 45*a* extends in the first direction D1 from a position partially overlapping the one first portion 45*a* in the third direction D3, and reaches the end surface 20*b*. Further, the third portion 45*c* extends in the first direction D1 between the one first portion 45*a* and the other first portion 45*a*. The second portion 45*b* extends in the third direction D3 while being bent and connects the first portion 45*a* to the third portion 45*c*.

According to such an electron multiplier 2B, it is possible to lengthen the first channel 21 and the second channel 22 and increase a gain. Further, according to the electron multiplier 2B, ion feedback in the first channel 21 and the second channel 22 is suppressed by the second portions 35*b* and 45*b* of the hole portion 35 and the hole portion 45.

Figure 11:
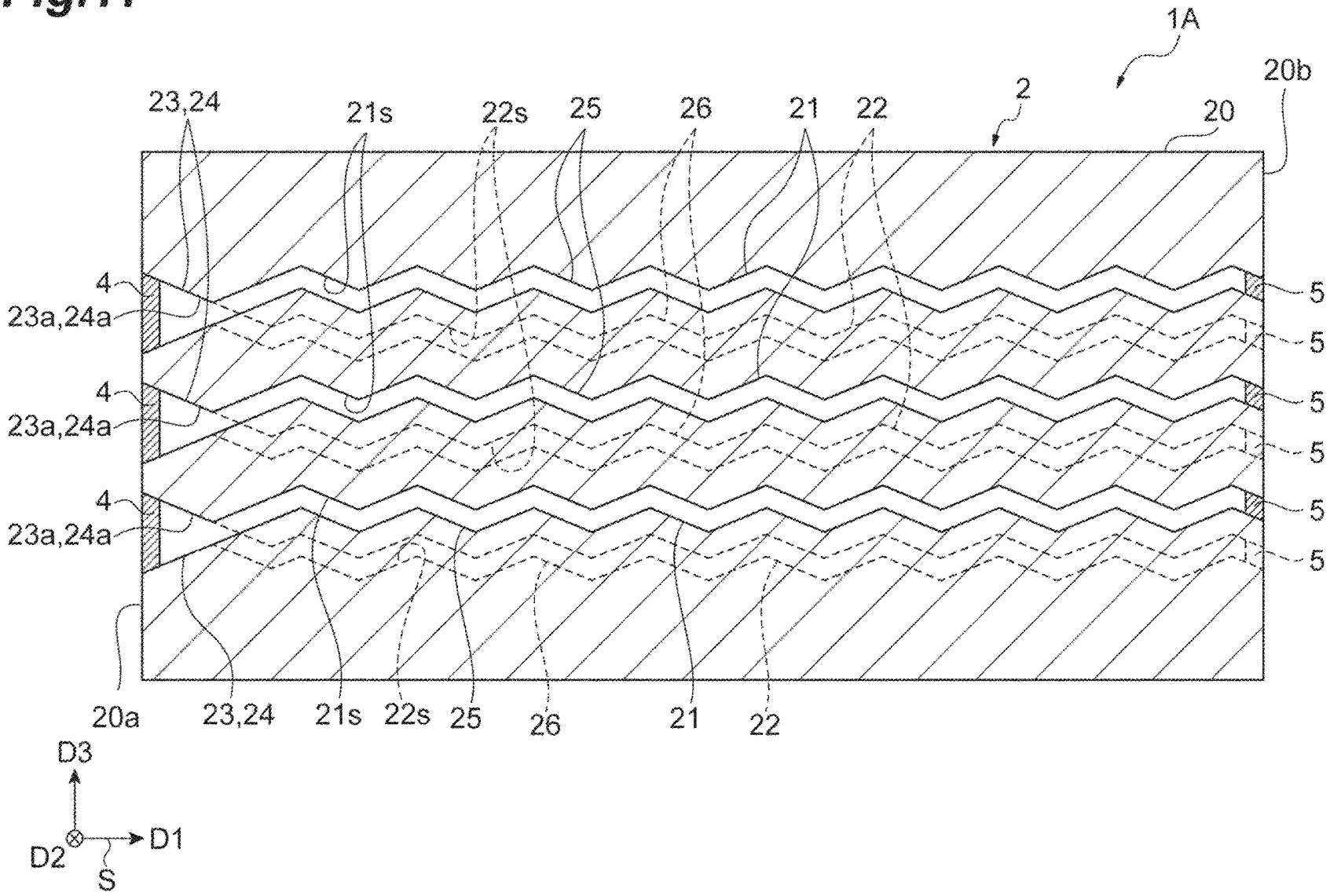
FIG. 11 is a diagram illustrating a photomultiplier tube according to a modification example.

FIG. 11 is a diagram illustrating a photomultiplier tube according to a modification example. As illustrated in FIG. 11, a photomultiplier tube 1A is different from the photomultiplier tube 1 in that the photomultiplier tube 1A does not include the tube body 3 and in the arrangement of the photoelectric surface 4 and the anode 5. That is, in the photomultiplier tube 1A, the photoelectric surface 4 is provided in the main body portion 20 to close the opening portions (openings) 23*a* and 24*a* of the first channel 21 and the second channel 22 on the end surface 20*a*. Further, the anode 5 is provided to close the openings of the first channel 21 and the second channel 22 on the end surface 20*b*. It should be noted that the photomultiplier tube 1A may include the electron multiplier 2A or the electron multiplier 2B in place of the electron multiplier 2.

Here, in the above embodiment, the main body portion 20 is made of an insulator. However, the main body portion 20

(that is, the first plate-shaped members 30 and the second plate-shaped members 40) may be made of, for example, a conductor such as a metal. In this case, an insulating film is formed between the inner surface 21*s* of the first channel 21/the inner surface 22*s* of the second channel 22 and the resistive layer.

INDUSTRIAL APPLICABILITY

It is possible to perform multi-channelization while suppressing an increase in dead space.

REFERENCE SIGNS LIST

1: Photomultiplier tube
2, 2A, 2B: Electron multiplier
3: Tube body
4: Photoelectric surface
5: Anode
20: Main body portion
20*a*: End surface (one end surface)
20*b*: End surface (other end surface)
21: First channel
22: Second channel
30: First plate-shaped member
31: Front surface (first front surface)
32: Back surface (second back surface)
33: Hole portion (third hole portion)
35: Hole portion (first hole portion)
37: Hole portion area (first hole portion area)
38: solid area (first solid area)
35*a*, 45*a*: First portion
35*b*, 45*b*: Second portion
40: Second plate-shaped member
41: Front surface (second front surface)
42: Back surface (second back surface)
43: Hole portion (fourth hole portion)
45: Hole portion (second hole portion)
47: Hole portion area (second hole portion area)
48: Solid area (second solid area)

The invention claimed is:

1. An electron multiplier comprising:

a main body portion extending in a first direction;

a first channel that is provided in the main body portion to open at one end surface and the other end surface of the main body portion in the first direction and emits secondary electrons according to incident electrons; and a second channel that is provided in the main body portion to open at the one end surface and the other end surface in the first direction and emits secondary electrons according to the incident electrons, wherein the main body portion includes a first plate-shaped member and a second plate-shaped member that are stacked on each other in a second direction intersecting the first direction to form the first channel and the second channel, the first plate-shaped member includes a first front surface and a first back surface intersecting the second direction, a first hole portion area in which a first hole portion reaching the first back surface from the first front surface and extending along the first front surface and the first back surface is formed, and a first solid area adjacent to the first hole portion area, the second plate-shaped member includes a second front surface and a second back surface intersecting the second direction, a second hole portion area in which a second hole portion reaching the second back surface from the second front surface and extending along the second front surface and the second back surface is formed, and a second solid area adjacent to the second hole portion area, the first hole portion area faces the second solid area in the second direction, the second hole portion area faces the first solid area in the second direction, the first channel is formed to include an inner surface of the first hole portion and a surface of the second solid area facing the inside of the first hole portion, the second channel is formed to include an inner surface of the second hole portion and a surface of the first solid area facing the inside of the second hole portion, a third hole portion that reaches the first back surface from the first front surface and extends from the one end surface to be connected to the first hole portion is provided in the first plate-shaped member, a fourth hole portion that reaches the second back surface from the second front surface and extends from the one end surface to be connected to the second hole portion is provided in the second plate-shaped member, the third hole portion and the fourth hole portion overlap each other in the second direction, and a channel entrance defined by the third hole portion and the fourth hole portion has a tapered shape.

2. The electron multiplier according to claim 1, wherein the first plate-shaped member includes a plurality of first hole portion areas and a plurality of first solid areas arranged in a third direction intersecting the first direction and the second direction, and the second plate-shaped member includes a plurality of second hole portion areas and a plurality of second solid areas arranged in the third direction.

3. The electron multiplier according to claim 1, wherein the main body portion includes a plurality of first plate-shaped members and a plurality of second plate-shaped members, and the first plate-shaped member and the second plate-shaped member are alternately stacked in the second direction.

4. The electron multiplier according to claim 3, comprising a plurality of first channels and a plurality of second channels arrayed in a third direction intersecting the first direction and the second direction, wherein respective pairs of first and second channels have one common entrance.

5. The electron multiplier according to claim 1, wherein each of the first hole portion and the second hole portion includes a first portion extending along the first direction and a second portion extending along a direction intersecting the first direction.

6. The electron multiplier according to claim 1, wherein a resistive layer and a secondary electron multiplication layer are formed in this order on an inner surface of the first hole portion, a surface of the second solid area facing the inside of the first hole portion, an inner surface of the second hole portion, and a surface of the first solid area facing the inside of the second hole portion.

7. The electron multiplier according to claim 6, wherein the first plate-shaped member and the second plate-shaped member are conductors, and an insulating, film is formed between the resistive layer and the inner surface of the first hole portion, the surface of the second solid area facing the inside of the first hole portion, the inner surface of the second hole portion, and the surface of the first solid area facing the inside of the second hole portion.

8. A photomultiplier tube comprising:

the electron multiplier according to claim 1;

a tube body that accommodates the electron multiplier;

a photoelectric surface that is provided in the tube body to face openings of the first channel and the second channel at the one end surface and supplies photoelectrons to the first channel and the second channel; and an anode that is arranged in the tube body to face openings of the first channel and the second channel at the other end surface and receives secondary electrons that are emitted from the first channel and the second channel.

9. A photomultiplier tube comprising:

the electron multiplier according to claim 1;

a photoelectric surface that is provided to close openings of the first channel and the second channel at the one end surface and supplies photoelectrons to the first channel and the second channel; and an anode that is provided to close openings of the first channel and the second channel at the other end surface and receives secondary electrons that are emitted from the first channel and the second channel.

10. The electron multiplier according to claim 1, comprising two or more pairs of the first channel and the second channel, wherein in each pair of the first channel and the second channel, the third hole portion and the fourth hole portion overlap each other in the second direction.

* * * * *